US006657182B1

(12) United States Patent
Klotz et al.

(10) Patent No.: US 6,657,182 B1
(45) Date of Patent: Dec. 2, 2003

(54) ATTACHMENT FOR A LIGHT UNIT HAVING A LIGHT DETECTOR AND ADJUSTABLE ATTACHMENT

(76) Inventors: Moshe Klotz, 19 Cadogan Gardens, London N3 2HN (GB); Hagai Sigalov, 20 Eastside Road, London NW11 0BA (GB)

( * ) Notice: Subject to any disclaimer, the term of this patent is extended or adjusted under 35 U.S.C. 154(b) by 0 days.

(21) Appl. No.: 09/914,674

(22) PCT Filed: Mar. 2, 2000

(86) PCT No.: PCT/GB00/00774

§ 371 (c)(1),
(2), (4) Date: Oct. 4, 2001

(87) PCT Pub. No.: WO00/52678

PCT Pub. Date: Sep. 8, 2000

(30) Foreign Application Priority Data

Mar. 2, 1999 (GB) ..... 9904794

(51) Int. Cl.[7] ..... G06M 7/00; H01J 40/14
(52) U.S. Cl. ..... 250/221; 340/556
(58) Field of Search ..... 250/239, 221, 250/222.1, 353; 340/693.5, 693.6, 693.9, 555, 556, 557; 84/464 R, 464 S, 477 R

(56) References Cited

U.S. PATENT DOCUMENTS 5,017,770 A 5/1991 Sigalov
5,025,516 A * 6/1991 Wilson ..... 4/623
5,045,687 A * 9/1991 Gurner ..... 250/221
5,166,463 A 11/1992 Weber
5,369,270 A 11/1994 Gurner
5,442,168 A 8/1995 Gurner

FOREIGN PATENT DOCUMENTS

FR 2741229 A 5/1997
GB 2 183 889 A 6/1987
GB 2246227 A 1/1992

* cited by examiner

*Primary Examiner*—Stephone B. Allen
*Assistant Examiner*—Eric Spears
(74) *Attorney, Agent, or Firm*—Birch, Stewart, Kolasch & Birch, LLP

(57) ABSTRACT

An attachment for a light unit, which attachment comprises light-detecting means adapted to generate an output signal corresponding to the intensity of light incident thereon, and adjustable attaching means for removably attaching said attachment to an existing light unit such that the light detecting means are positioned within a beam of light emitted by the light unit when operated and are adapted to detect light that is directed towards the light unit, said attaching means being adjustable to allow the attachment to be selectively fitted to a range of different existing light units. Particularly, said light sensing means are adapted to sense light from the light unit that is retro-reflected back towards the light unit.

14 Claims, 3 Drawing Sheets

ATTACHMENT FOR A LIGHT UNIT HAVING A LIGHT DETECTOR AND ADJUSTABLE ATTACHMENT

This application is the national phase under 35 U.S.C. §371 of PCT International Application No. PCT/GB00/00744 which has an International filing date of Mar. 2, 2000, which designated the United States of America and was published in English.

FIELD OF THE INVENTION

The present invention relates to an attachment for a light unit.

BACKGROUND OF THE INVENTION

U.S. Pat. No. 5,017,770 and GB-B-2183889 (Sigalov) disclose interactive light-to-MIDI equipment comprising a support assembly and a plurality of light units. Said support assembly comprises a structure consisting of a plurality of telescopic arms which are pivoted on a central hub. Said hub may be suspended from a ceiling or other superstructure, and the arms may be manipulated such that they extend radially outwardly of the hub. Said light units are mounted on the arms, and each comprises a lamp that is adapted emit a beam of light generally downwardly, and an integrant light sensing element that is positioned in front of the lamp in the beam. Said light sensing element is shielded from direct light from the lamp, but is adapted to detect light that is retroreflected back towards the light unit.

Said light sensing element may comprise a photoresistive diode which is connected to an analogue to digital pulse generator. Said pulse generator converts the analogue output of the detector to a digital "trigger" signal which is MIDI compatible. In turn, the output of the pulse generator can be connected to a MIDI interface, and this can be connected to sound generator or other MIDI device of kinds well known to those skilled in the art. The MIDI interface can be set up to transmit a MIDI instruction to the sound generator or other MIDI-control device in response to a digital "trigger" pulse from the pulse generator.

In use, a user such, for example, as a musician or dancer operates the equipment by wearing or carrying on part of his or her body a piece of rectroreflective material. When the user cuts a beam of light from one of the light units with the rectroreflective material, then part of the beam is retroreflected back towards the light unit, thus activating the light sensing element. Alternatively the system can be operated in an "inverse mode" in which a piece of retroreflective material is disposed at a fixed, remote location in front of each light unit. Light from the light unit is thus constantly reflected back towards the light unit by the retroreflective material, and is incident on the light sensing element. In this case the user does not need to be equipped with retroreflective material, but will cause a discontinuity in the output of the light sensing element simply by interrupting the beam of light with a non-reflecting member such, for example, as part of his or her body, thus shading the fixed retroreflective material from the beam. Such interruption in the output of the light sensing element is converted by the pulse generator into a control signal.

Most commonly, the equipment will be used to drive a sound generator such, for example, as a music synthesizer or drum computer. The output of each respective light unit may be used to generate a different note or sound. U.S. Pat. No. 5,017,770 and GB-B-2183889 disclose that the outputs of a group of light units may be connected through appropriate electronic circuitry to provide control over a different MIDI parameter in addition to the digital trigger signal. Thus, the speed at which two juxtaposed beams are cut by a user may, for example, be used to provide volume control. U.S. Pat. No. 507,770 and GB-B-2183889 also disclose that the equipment may be used to control non-sound devices such as other lighting devices and devices which can move objects, release smoke or odours, provide temperature control or release stage snow, stage rain or balloons or the like. The light emitted by the lamp of each light unit may be visible or invisible, although for most music applications, it is envisaged that each lamp will generate a different colour of visible light.

U.S. Pat. No. 5,017,770 and GB-B-2,183,889 thus disclose an integrated light-to-MIDI system that comprises light units, light sensing elements and electronic equipment for converting the output of the light sensing elements to MIDI instruction code. Such equipment works well, but is self-contained and therefore difficult to integrate with pre-existing equipment.

BRIEF SUMMARY OF THE INVENTION

According to the present invention there is provided an attachment for a light unit, which attachment comprises light-detecting means, adapted to generate an output signal corresponding to the intensity of light incident thereon, and adjustable attaching means for removably attaching said attachment to a light unit such that the light-detecting means are positioned within a beam of light emitted by the light unit in use and are adapted to detect light that is directed towards said light unit, said attaching means being adjustable to allow the attachment to be selectively fitted to a range of differently sized light units.

The invention thus provides an attachment which can be fitted to a pre-existing light unit to convert the light unit into an interactive light-operated controller. It is envisaged that said adjustable attaching means may be adapted to attach the attachment to a wide variety of different kinds of light units without restriction. In particular, the attaching means may be adapted for connecting the light sensing means to known kinds of theatre lighting, including ellipsoidals, pars, fresnels and pinspots.

Preferably, said light sensing means comprises a light sensing element and shielding means for shielding the light sensing element from direct light emitted by the light unit and/or ambient light, so as to avoid false positive readings. Said shielding means may comprise an opaque, elongate housing that is arranged substantially co-axially with the beam when the attachment is fitted to a light unit, which housing is closed at one end that is disposed closest to the light unit and is open at its other end, the light sensing element being disposed within the housing. In some embodiments, said housing may comprise a tube that is closed at said one end, with the light sensing element being mounted within the tube. Said housing serves to ensure that the only retroreflected light impinges on the light sensing element to provide stable operation of the attachment. Operation of the light sensing element may be further enhanced by the provision of lens means for concentrating said retroreflected light onto the light sensing element.

Said attaching means may be adapted such that, when fitted to a light unit, said light sensing means is positioned generally centrally within the beam emitted by the light unit. In some embodiments, said attaching means may comprise adjustable positioning means for adjusting the position of the light sensing means relative to the light unit.

It will be appreciated that the present invention is not limited to any particular form or configuration of attaching means. The invention embraces a wide variety of different kinds of attaching means suitable for attaching the light sensing means to a wide variety of different kinds of theatre lighting as mentioned above. Furthermore, said attaching means may comprise mechanical fastening means for fastening the attachment to a light unit, or alternatively other kinds of releasable fastening means may be employed such, for example, as magnetic fasteners and adhesive pads. In some embodiments, the attaching means may be adapted simply to allow the attachment to be placed on the light unit or a part connected thereto such that the light unit is retained in position by gravity and optionally one or more stops to prevent lateral movement.

In some embodiments of the invention, said attachment may further comprise pulse generating means for converting the output signal of the light sensing means into a digital or analogue signal, particularly a control signal. Typically, said signal may be a MIDI compatible signal.

Said attachment may further comprise signal transmitting means for transmitting the output signal of said light detecting means to a suitable remote receiver. Said transmitting means may comprise electromagnetic wave transmitting means for transmitting said control signal to a remote receiver on an electromagnetic carrier wave. In some particularly preferred embodiments of the invention, said transmitting means may be adapted to provide an infra-red carrier signal for carrying the control signal. Of course, the invention does not preclude the possibility that the output of the light sensing means or pulse generating means may be hard-wired into a suitable receiver.

The attachment of the invention may be provided with appropriate power leads for connecting the light sensing means and optional pulse generating means to a source for electrical power. However, in some embodiments, the attachment may further comprise photovoltaic generator means to provide electrical power to the attachment, which photovoltaic generator means are positioned in the beam of light emitted by the light unit in use, when the attachment is attached to said light unit. Said photovoltaic generator may comprise at least one photovoltaic cell.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Following is a description by way of example only with reference to the accompanying drawings, which are given by way of illustration only, and thus are not limitative of the present invention, and of methods of carrying the present invention into effect.

DETAILED DESCRIPTION OF THE INVENTION

Figure 1:
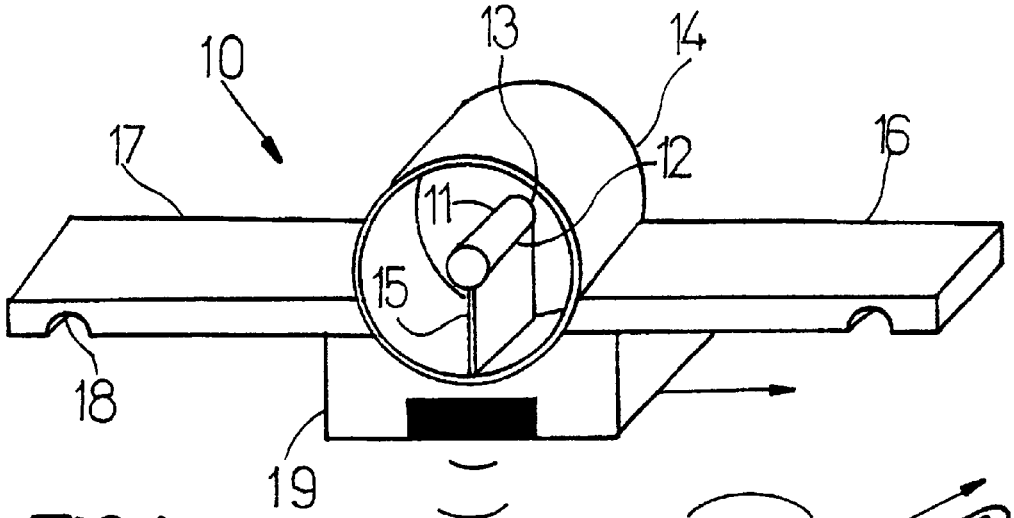
FIG. 1 shows a first embodiment of an attachment in accordance with the present invention which is adapted to be supported on a pair of powered lamp bars.

With reference to FIG. 1, an attachment 10 in accordance with a first embodiment of the present invention comprises a light sensor 11 comprising an opaque, elongate tube 12 which is closed at one end 13 and accommodates a light sensing element (not shown) such as a photo-resistive diode.

Said light sensor 11 is mounted substantially co-axially within an annular shield member 14 by means of a radial vane 15. Said annular shield member 14 carries two opposing elongate supporting arms 16,17, each of which is provided with an undercut channel 18 remote from the annular shield member 14 to engage a respective powered lamp bar (not shown). Within each recess, said arm 16,17 carries a conducting contact element that is adapted to form an electrical contact with said bar. Said contact element is connected to the electrically operated component of the attachment to provide power thereto.

The light sensing element within the elongate tube 12 is connected to a pulse generator (not shown) which is configured to generate a MIDI compatible trigger pulse when light impinges on the light sensing element. The output of said pulse generator is connected to an infra-red transmitter device 19 which is secured to the annular shield member 14 between the supporting arms 16,17 as shown in FIG. 1.

In use, said attachment 10 can be mounted on a pair of spaced lamp bars in juxtaposition with a pre-existing light unit, such that the light sensor 11 is mounted substantially centrally within a beam of light generated by the light unit. The attachment 10 is mounted on the lamp bars, such that the closed end 13 of the elongate tube 12 is oriented towards the light unit, and the other open end is directed away from the light unit. The elongate tube 12 serves to shield the light sensing element from ambient light and direct light emitted by the light unit.

A user may be equipped with a piece of retroreflected material. When the user cuts the beam of light from the light unit with said retroreflective material, some of the light is retroreflected back towards the light unit and impinges on the light sensing element within the tube 12, thereby generating a trigger pulse from the pulse generator which is transmitted by the infra-red transmitter 19 to a central receiving hub (not shown). (Alternatively, the system can be operated in an "inverse mode" as described above). Typically such a receiving hub would include a MIDI interface for converting the trigger pulse to MIDI instruction code for controlling a music synthesizer, drum computer or other MIDI-controlled device.

Figure 2:
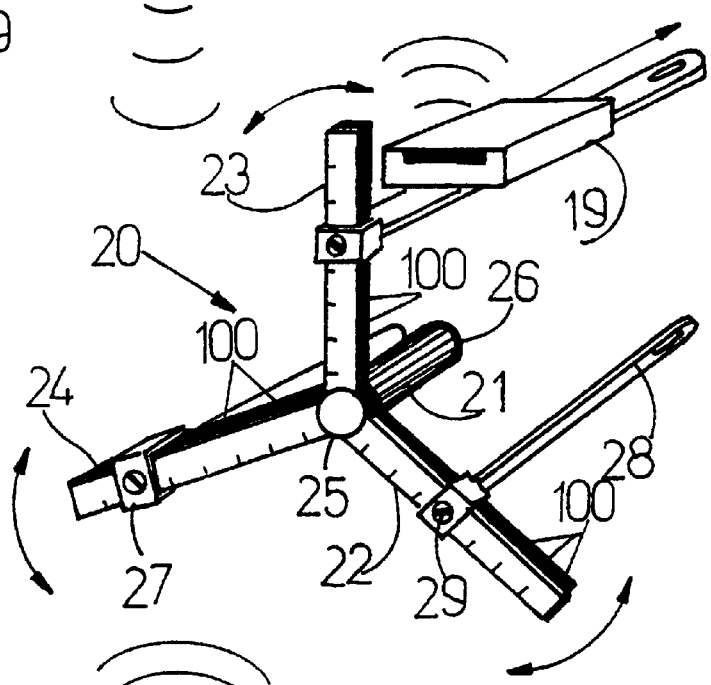
FIG. 2 shows a second embodiment of an attachment in accordance with the present invention.

With reference to FIG. 2, an attachment 20 according to a second embodiment of the invention comprises a light sensor 21 which is substantially the same as the light sensor 11 included in the attachment 10 of the first embodiment described above. Said sensor carries 3 radially extending arms 22,23,24 which are pivoted to the open end 25 of the sensor. (Alternatively, the arms 22,23,24 could be pivoted to the closed end 26). Each of said radially extending arms 22,23,24 is marked with a graduated scale and carries a slider 27 which is fitted with an elongate finger 28. Said slider 27 includes a grub screw or the like 29 for releasably securing the slider 27 in a selected position along the respective arm 22,23,24. Said arms 22,23,24 are adapted to embrace the body of a light unit (not shown) such, for example, as ellipsoidal, par, pinspot or fresnel lamp, and the arms 22,23,24 can be pivoted about the sensor 21 and the sliders 27 adjusted, so that the attachment 20 can be fitted to a variety of different sizes of light unit. Said arms 22,23,24 may be provided with suitable fixing means for releasably securing the arms to the light unit. For example, the fingers 28 may be equipped with screws or bolts for engaging cooperating components on the light unit. Alternatively, each finger 28 may be equipped with a magnetic element or strip. As a further possibility, a strap may be used which may be secured around all the fingers when fitted to a light unit to hold the fingers securely to the body of the light unit.

Said light sensor 21 may be equipped with a pulse generator of the kind referred to above in connection with the first embodiment of the invention, and the output of the pulse generator may be connected to a central hub by wires, alternatively, by an infra-red transmitter 19 which may be mounted on one of the fingers 28.

Advantageously, one or more the radially extending arms 22,23,24 may be equipped with one or more photovoltaic cells 100 which are arranged to face the lamp unit, when the attachment 20 is fitted to the lamp unit. The photovoltaic cells may be used to provide power to the sensor and optional infra-red transmitter 19.

Figure 3:
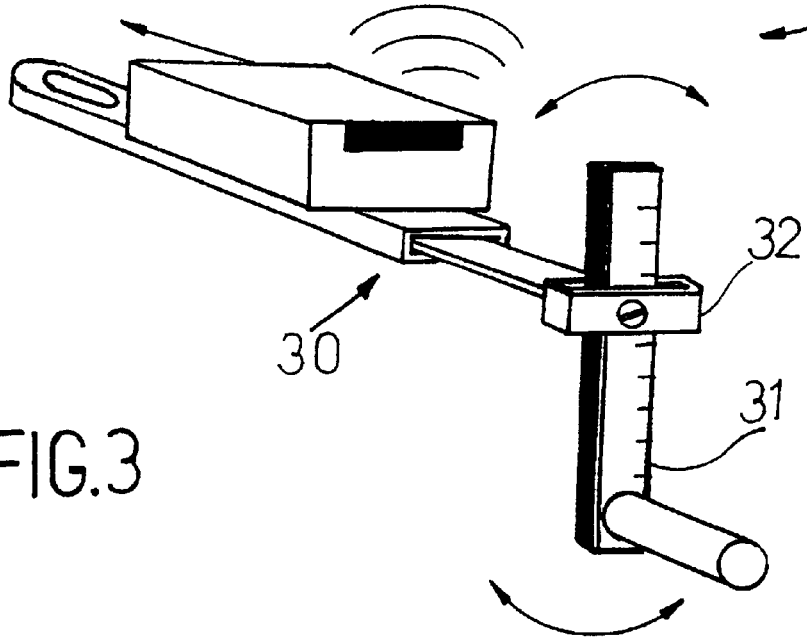
FIG. 3 shows a third embodiment of an attachment in accordance with the present invention.
Figure 4:
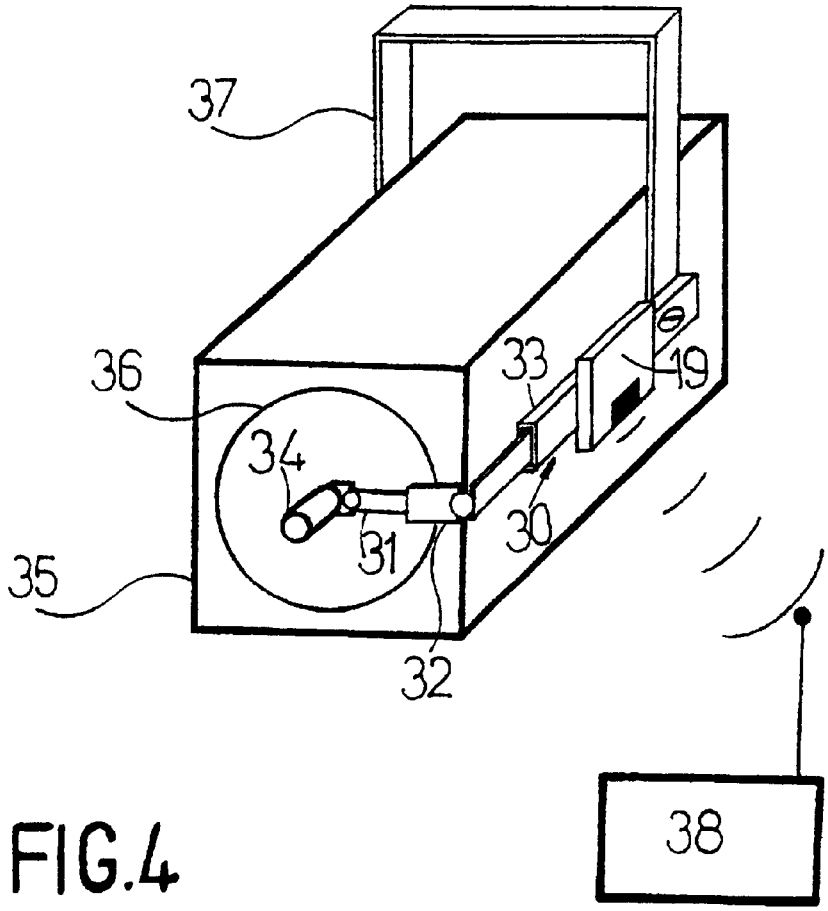
FIG. 4 shows the attachment of FIG. 3 as fitted to a theatre light.
Figure 5:
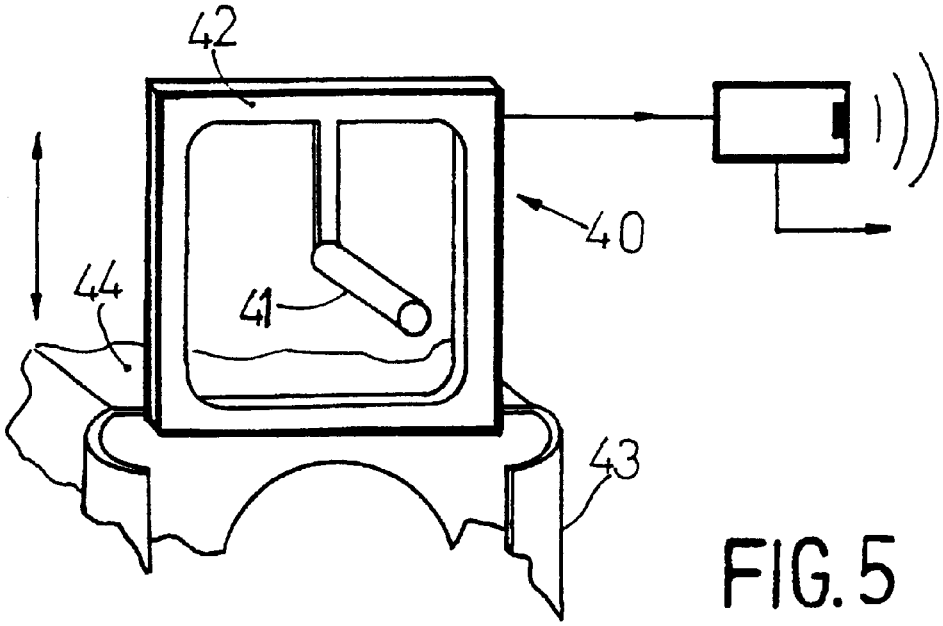
FIG. 5 shows a fourth embodiment of an attachment in accordance with the present invention which is adapted to be held in the colour frame of a theatre light unit.

An attachment 30 in accordance with the third embodiment of the invention is illustrated in FIG. 3. The attachment 30 is similar in construction to the attachment 20 of FIG. 2, except that it includes only a single arm 31, which arm 31 is equipped with a slider 32 and elongate finger 33 in the same way as each arm 22,23,24 of FIG. 2. FIG. 4 shows the attachment 30 of FIG. 3 fitted to a theatre light unit 35, such that the light sensor 34 is positioned substantially centrally of the lamp 36 of the light unit 35. In this case, it can be seen that the elongate finger 33 is fixedly secured to a hanging bracket 37 of the light unit 35 and includes an infra-red transmitter 19 that is adapted to transmit MIDI compatible digital control signal to a receiver 38 connected to a MIDI interface and MIDI-controlled equipment such, for example, as a synthesizer. Another alternative attachment 40 in accordance with the fourth embodiment of the invention is illustrated in FIG. 5. In this case, the light sensor 41 is mounted substantially centrally within a square frame 42 that is adapted to be received in the colour frame 43 of a light unit 44.

Figure 6:
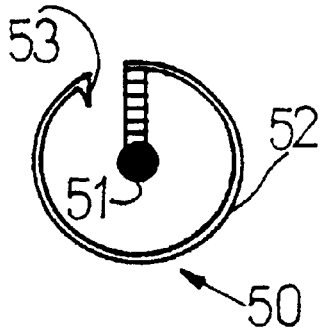
FIG. 6 is an end view of a fifth embodiment of an attachment in accordance with the present invention.

A fifth embodiment of the invention is shown in FIG. 6 which illustrates an attachment 50 in which a light sensor 51 is mounted substantially co-axially within a circular band spring 52. Said band spring 52 is open at 53, so that the spring can be opened out and entered over or inside the body of a light unit (not shown). The elasticity of the band spring 52 allows the attachment 50 to be secured firmly to the light unit.

Figure 7:
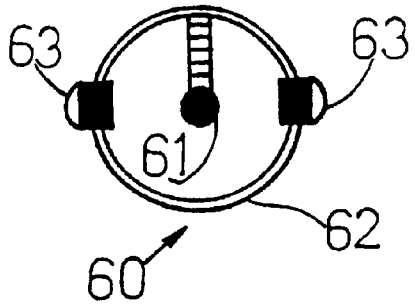
FIG. 7 is an end view of a sixth embodiment of the invention.

FIG. 7 shows a sixth embodiment of the invention in which an attachment 60 comprises a light sensor 61 that is mounted co-axially within a loop defined by an endless elastic band 62. Said band is provided with a pair of opposing slide clips 63. Said attachment 60 is configured such that it can be entered over the front of a circular light unit (not shown), and the clips 63 are adapted to sliderably engage a protruding annular flange on the light unit. The elasticity of the band 62 allows the attachment to accommodate the range differently sized units.

Figure 8:
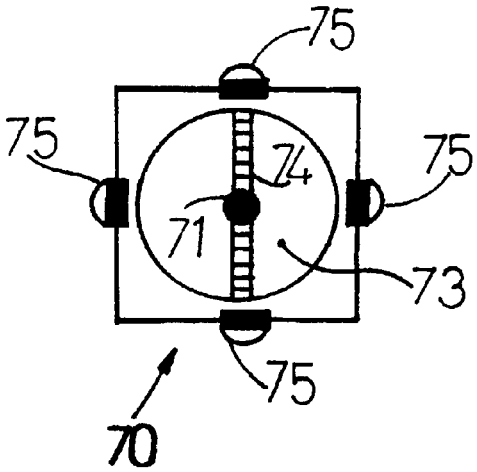
FIG. 8 is an end view of a seventh embodiment of the invention.

A seventh embodiment of the invention is illustrated in FIG. 8. According to the seventh embodiment, an attachment 70 comprises a light sensor 71 which, in this case, is generally square. Said frame is formed from a sheet of structural material such as metal (e.g. aluminum or light steel) or plastics, and is provided with a central hole 73. Said light sensor 71 is mounted within the hole 73 on a vane or other support 74. Said frame 72 is equipped with a plurality of slide clips of the kind described above with reference to the sixth embodiment. In the embodiment shown, four clips are used, and these are mounted one each on each of the four sides of the frame. However, it is envisaged that more or fewer clips may be used as necessary.

Figure 9:
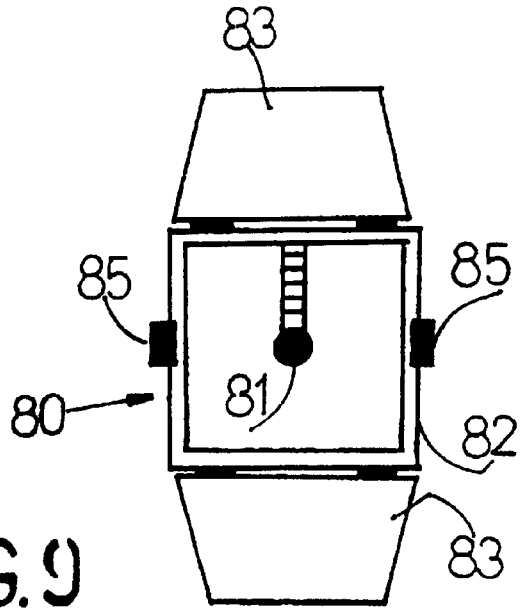
FIG. 9 is an end view of an eighth embodiment of the invention.

An attachment 80 according to an eighth embodiment of the invention is shown in FIG. 9, which attachment 80 also comprises a light sensor 81 mounted substantially centrally within a rectilinear frame 82. In the eighth embodiment as illustrated, the frame is provided with two clips 85 mounted on opposing sides of the frame. The other pair of opposing sides of the frame each carry a hinged wing 83 which can be used in conventional manner to control the spread of light from a light unit to which the attachment 80 is attached. Alternatively the wings 83 could be folded backwards for use in attaching the attachment to a light unit.

Figure 10:
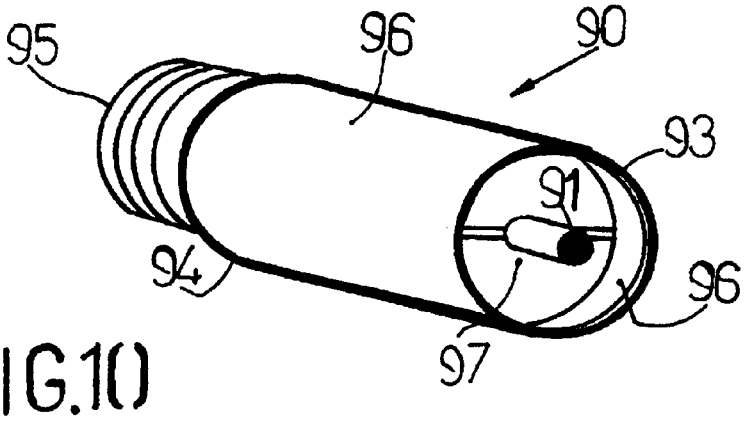
FIG. 10 is an isometric view of a screw-fitting attachment in accordance with a ninth embodiment of the invention.

According to a ninth embodiment of the invention as illustrated in FIG. 10, an attachment 90 comprises a light sensor 91 of the kind described above which is mounted within a generally cylindrical, opened-ended barrel 92 which carries an internal lens 97. Said light sensor 91 is mounted on said lens 97 within the barrel, such that the open end of the sensor faces one open end 93 of the barrel. The other open end 94 of the barrel is provided with a hollow threaded stem 95 which is suitable for attaching the attachment 90 to a cooperating threaded bore formed around a lamp orifice of a light unit (not shown). Said open end 93 of the attachment 90 may be equipped with a protruding cylindrical flange portion 96 which may be internally threaded to receive further threaded attachments such as lenses, colour filters and the like. The outer surface of the barrel 92 may be provided with a roughened or knurled finger engaging surface 96 to facilitate attachment of the barrel 92 to and detachment from a cooperating light unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attachment for a light unit, which attachment comprises light-detecting means adapted to generate an output signal corresponding to the intensity of light incident thereon and adjustable attaching means for removably attaching said attachment to a light unit such that the light-detecting means are positioned within a beam of light emitted by the light unit in use and are adapted to detect light that is directed towards said light unit, said attaching means being adjustable to allow the attachment to be selectively fitted to a range of differently sized light units.

2. An attachment as claimed in claim 1, wherein said light sensing means are adapted to sense light from said light unit that is retroreflected back towards the light unit.

3. An attachment as claimed in claim 1, wherein said light-detecting means comprise a light sensitive element and shielding means for shielding the light sensitive element from direct light emitted by the light unit and/or ambient light.

4. An attachment as claimed in claim 3, wherein said shielding means comprise an opaque, elongate housing that is arranged co-axially within said beam when the attachment is fitted to a light unit, which housing is closed at one end that is disposed closest to the light unit and is open at its other end, the light sensitive element being disposed within the housing.

5. An attachment as claimed in claim 3, wherein said light-sensitive element is positioned substantially centrally within the beam when fitted to a light unit.

6. An attachment as claimed in claim 3, wherein said light-detecting means further comprise lens means for focussing light onto said light-sensitive element.

7. An attachment as claimed in claim 1, wherein said attaching means comprises adjustable positioning means for adjusting the position of the light-detecting means relative to the light unit.

8. An attachment as claimed in claim 1, wherein said attachment further comprises pulse generating means for converting the output signal of the light-detecting means into a digital signal.

9. An attachment as claimed in claim 8, wherein said digital signal is a MIDI compatible signal.

10. An attachment as claimed in claim 1, further comprising signal transmitting means for transmitting the output signal of said light detecting means to a remote receiver.

11. An attachment as claimed in claim 10, wherein said transmitting means comprise electromagnetic wave transmitting means for transmitting said output signal to a suitable receiver on an electromagnetic carrier wave.

12. An attachment as claimed in claim 11, wherein said transmitting means is adapted to transmit an infrared carrier signal.

13. An attachment as claimed in claim 1, wherein said attachment further comprises photovoltaic generator means to provide electrical power to the attachment, which photovoltaic generator means are positioned in said beam of light emitted by the light unit in use when the attachment is attached to said light unit.

14. An attachment as claimed in claim 13, wherein said photovoltaic generator means comprises at least one photovoltaic cell.

* * * * *